US007988004B1

(12) United States Patent
Marret et al.

(10) Patent No.: US 7,988,004 B1
(45) Date of Patent: Aug. 2, 2011

(54) DISPENSING CLOSURE WITH TAMPER EVIDENT DEVICE

(75) Inventors: J. Nathan Marret, Newburgh, IN (US); Thomas Stoneberg, Buffalo Grove, IL (US); Troy Tacke, Chicago, IL (US)

(73) Assignee: Rexam Closures and Containers Inc., Evansville, IN (US)

( * ) Notice: Subject to any disclaimer, the term of this patent is extended or adjusted under 35 U.S.C. 154(b) by 501 days.

(21) Appl. No.: 12/051,161

(22) Filed: Mar. 19, 2008

(51) Int. Cl.
*B65D 41/40* (2006.01)
*B65D 51/18* (2006.01)

(52) U.S. Cl. ..... 215/252; 220/254.8

(58) Field of Classification Search ..... 220/254.8, 220/254.9, 254.3, 254.1, 270, 266, 265, 260, 220/345.4, 345.1, 345.6, 212, FOR. 184, 220/FOR. 183, FOR. 203, 200; 215/228, 215/223, 220, 219, 218, 217, 214, 211, 256, 215/254, 253, 252, 250, 201, 200; 222/570, 222/568, 567, 566, 560, 559, 562, 548, 544, 222/541.6, 541.1, 153.07, 153.06, 153.05, 222/153.01; D9/450, 449, 447, 436, 435, D9/434; *B65D 41/40, 41/32, 51/18, 51/00*
See application file for complete search history.

(56) References Cited

U.S. PATENT DOCUMENTS 4,709,823 A * 12/1987 Beck et al. ..... 215/235
4,711,364 A * 12/1987 Letica ..... 220/276
4,967,941 A * 11/1990 Beck ..... 222/521
5,007,545 A * 4/1991 Imbery, Jr. ..... 215/14
5,027,964 A * 7/1991 Banich, Sr. ..... 215/252
5,088,613 A * 2/1992 Dutt et al. ..... 215/250
5,328,063 A * 7/1994 Beck et al. ..... 222/524
5,456,374 A * 10/1995 Beck ..... 215/251
5,782,383 A * 7/1998 Robinson ..... 222/81
5,829,611 A * 11/1998 Beck ..... 215/252
5,842,592 A * 12/1998 Beck ..... 215/253
5,971,182 A * 10/1999 Berge et al. ..... 215/252
5,975,369 A * 11/1999 Yurkewicz et al. ..... 222/153.06
6,135,329 A * 10/2000 Stoneberg et al. ..... 222/521
6,299,038 B1 * 10/2001 Schmeisser et al. ..... 222/521
6,338,425 B1 * 1/2002 Berge et al. ..... 222/521
6,540,114 B1 * 4/2003 Popovich et al. ..... 222/153.02
2004/0251276 A1 * 12/2004 Adams et al. ..... 222/153.14

FOREIGN PATENT DOCUMENTS

ES 1002990 7/1988

* cited by examiner

*Primary Examiner* — Mickey Yu
*Assistant Examiner* — Robert J Hicks
(74) *Attorney, Agent, or Firm* — Chad D. Bruggeman; John F. Salazar; Middleton Reutlinger

(57) ABSTRACT

A dispensing closure having a tamper evident device. The closure having a spout positionable between an open position and a closed position relative to a closure base. An overcap with a tamper indicating band having an anti-rotational mechanism interacting with the closure base. The closure base has a plurality of projecting flanges engaging the tamper indicating band. The projecting flanges of the closure base curve towards the spout of the dispensing closure. The tamper indicating band of the overcap is supported interiorly by the spout in both the open position and closed position of the spout.

21 Claims, 10 Drawing Sheets

DISPENSING CLOSURE WITH TAMPER EVIDENT DEVICE

TECHNICAL FIELD

The present invention relates to a closure and particularly to a dispensing closure with a tamper evident device.

DETAILED DESCRIPTION

Figure 1:
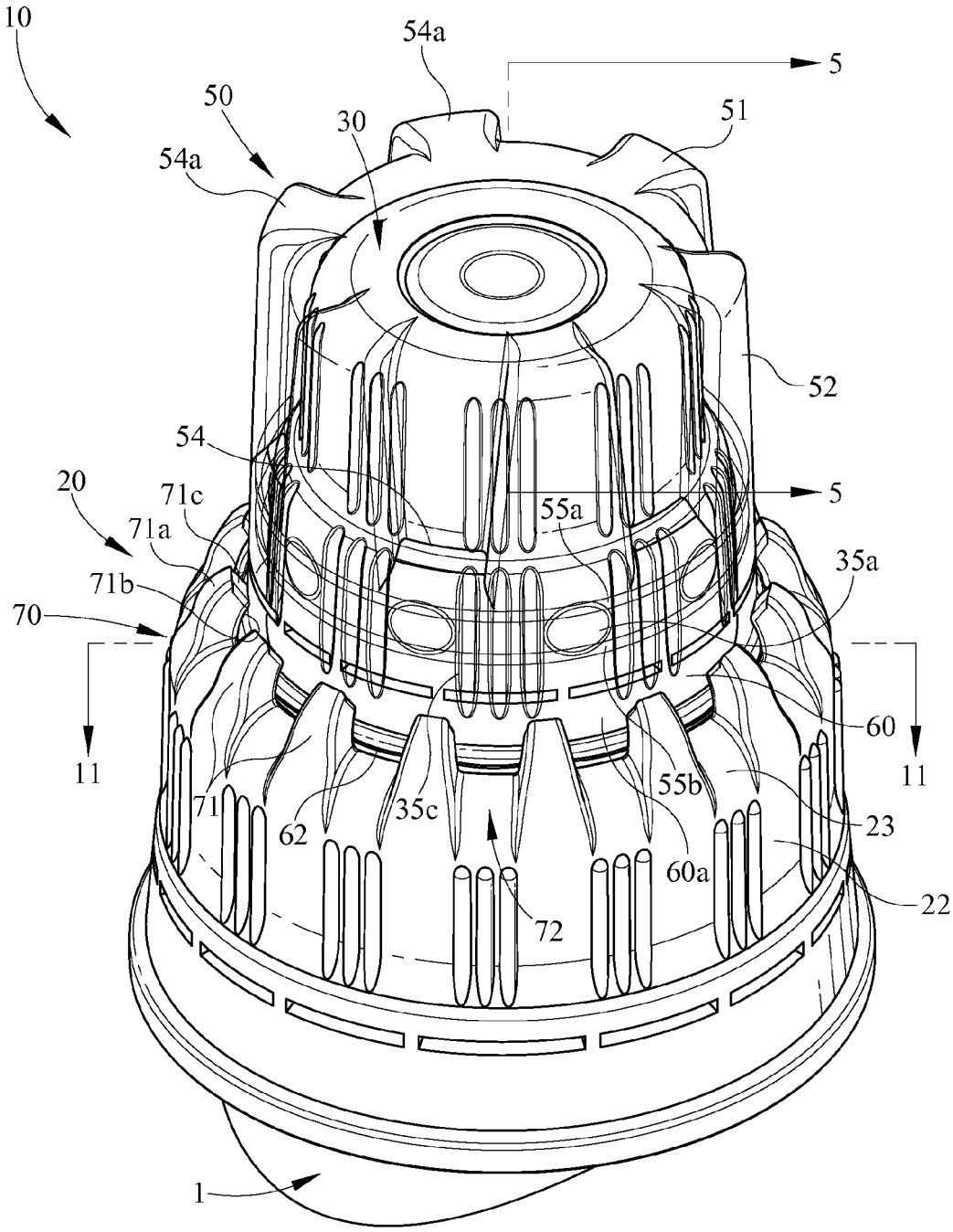
FIG. 1 shows a top perspective view of an embodiment of a dispensing closure, with portions of the container partially broken away.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," "in communication with" and "mounted," and variations thereof herein are used broadly and encompass direct and indirect connections, couplings, and mountings. In addition, the terms "connected" and "coupled" and variations thereof are not restricted to physical or mechanical connections or couplings.

Furthermore, and as described in subsequent paragraphs, the specific mechanical configurations illustrated in the drawings are intended to exemplify embodiments of the invention and that other alternative mechanical configurations are possible.

Referring to FIGS. 1-11, a closure 10 comprises a base 20 and cap or spout 30. Closure 10 is illustrated as a twist top dispensing closure, but other closures, such as pull/push closures, may function within the intended scope of the invention. Closure 10 may be formed of a rigid or semi-rigid polymeric material such as polyethylene, polypropylene, or some other material commonly known to one of ordinary skill in the closure art. Moreover, closure 10 may be formed in a variety of sizes depending on the desired use of the closure and container associated therewith.

As shown in FIGS. 1, 3, 5-7, 10, and 11, base 20 is adapted for attachment to a container neck 2 of a container 1 in a known manner, such as by helical threads 28 formed on the inner surface of a cylindrical side wall 22 of the base which mate with like threads 3 on the container neck. Base 20 also includes a deck 23 extending inwardly from base side wall 22. A vertically elongate post 24, integrally molded with the deck 23, extends vertically therefrom coaxial with and inwardly spaced from the surrounding side wall 22. Post 24 has a cylindrical post side wall 26 defining a product flow passage 25 vertically therethrough and opening through deck 23. Post 24, having a radial dimension less than that of base side wall 22, forms a concentric channel 40 about the post and between post side wall 26 and a flange 71 defined from the upper portion of base side wall 22 peripherally thereabout and extending upwardly from base deck 23. The external surface of post side wall 26 includes a lower portion 26*c* and an upper portion 26*a* with an annular abutment surface or shoulder 26*b* formed therebetween.

Figure 5:
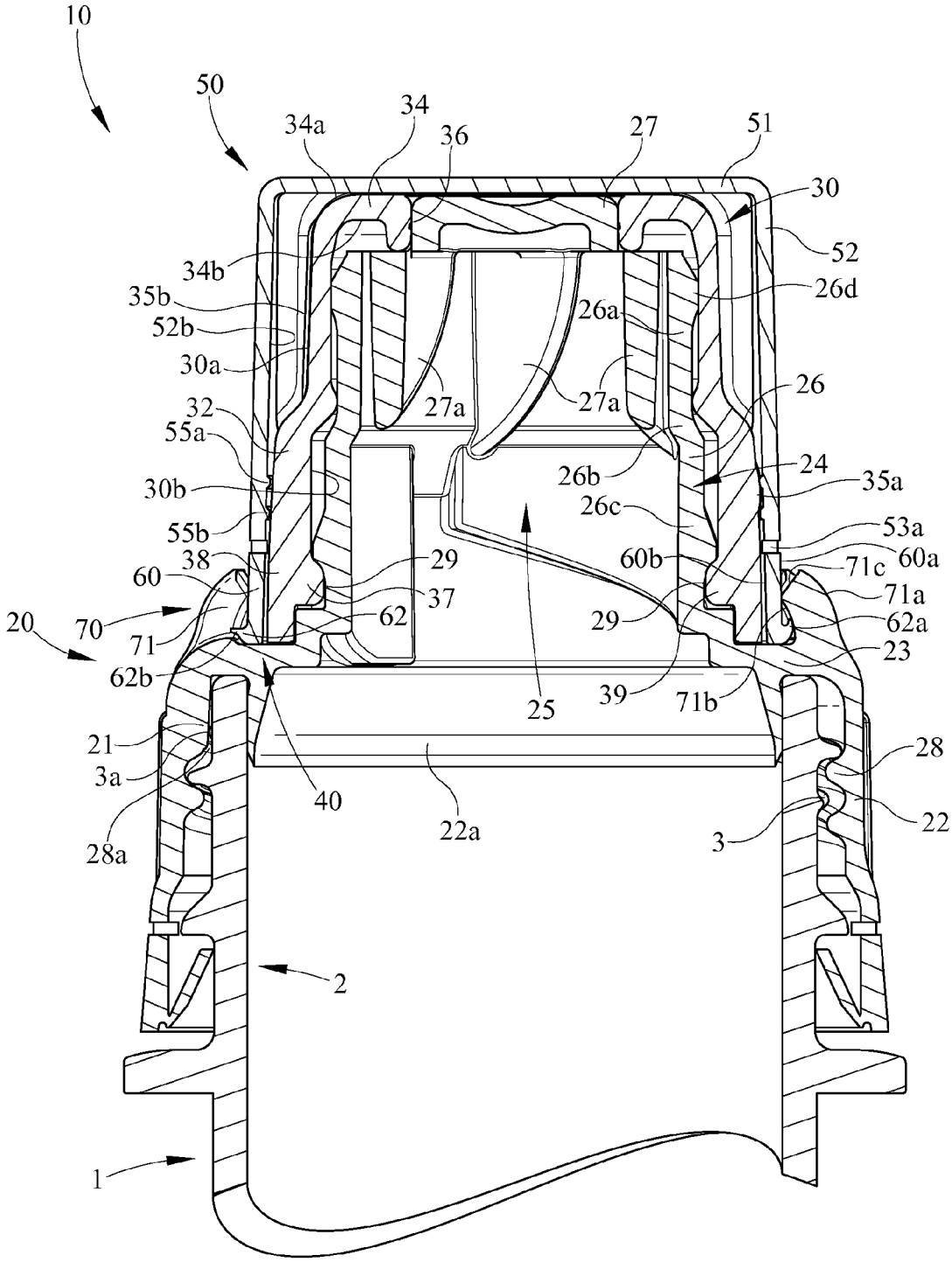
FIG. 5 shows a sectional view of the dispensing closure embodiment of FIG. 1 taken along line 5-5.
Figure 6:
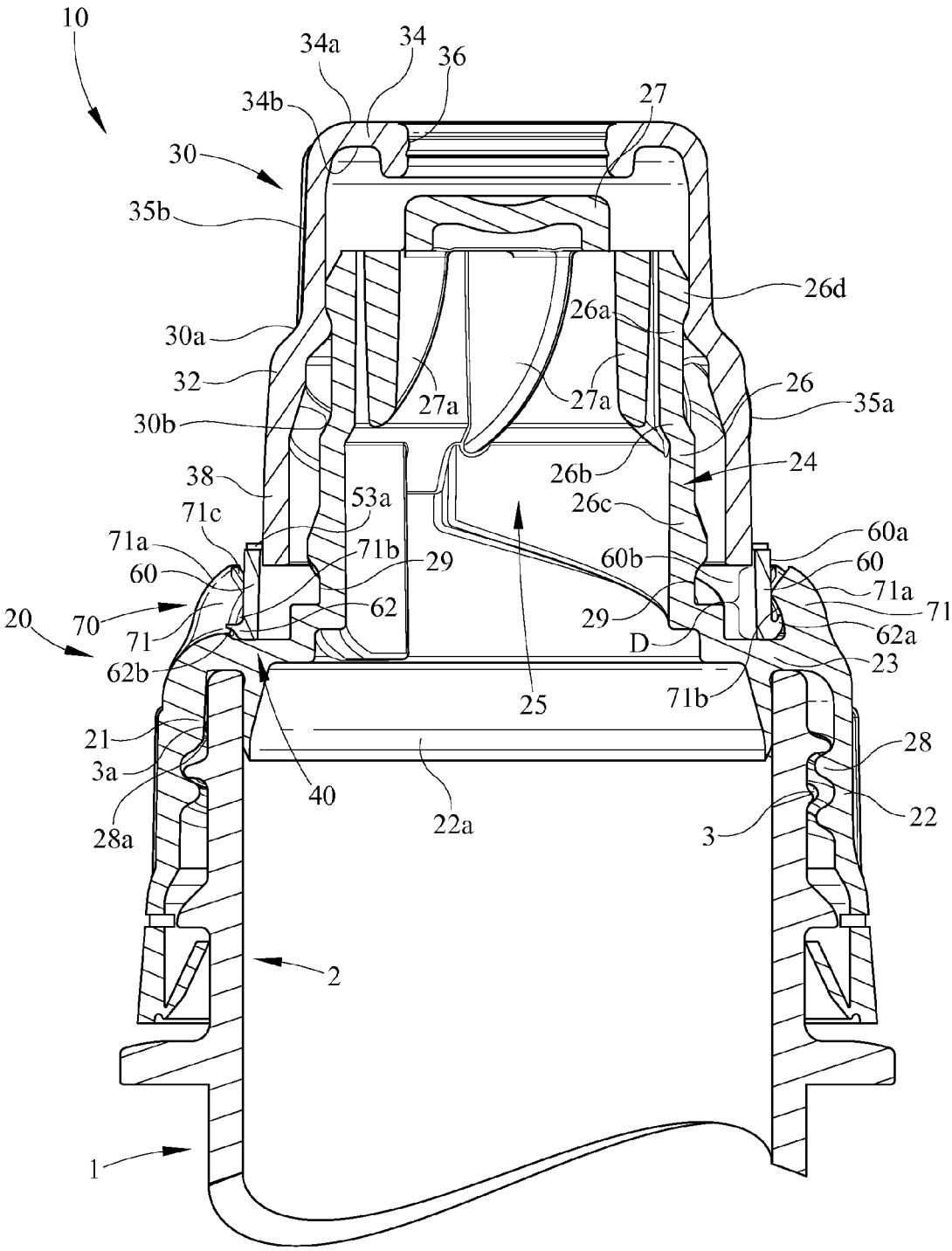
FIG. 6 shows a sectional view of the closure embodiment of FIG. 5 illustrating the tamper indicating feature of the overcap has been overcome and the spout is positioned into its open position.

As shown in FIGS. 5 and 6, an annular sealing rib 26*d* is formed proximate to the upper terminal end of upper portion 26*a* of post 26 and extends circumferentially about the external surface of the post. A sealing plug 27 is centrally positioned within the upper terminal end portion of post 24 and projects vertically therefrom in radially inwardly spaced relation to the post wall. As shown in FIGS. 5-7, and 10, plug 27 is supported by a support spider formed of spaced radially extending spokes 27*a* which minimally restrict the flow of discharging product annularly about plug 27 when spout 30 is in its open position (FIG. 6), as will be described subsequently. Lower portion 26*c* of post sidewall 26 is formed with a pair of diametrically opposed helical groove channels 29.

As shown in FIGS. 1-6, twist spout 30 is formed with an upstanding wall 32 having a top platform 34 with aperture 36 therethrough extending between upper surface 34*a* and lower surface 34*b* of platform 34, and a lower terminal end 38 with a plurality of circumferentially projecting bumps 35*a* formed proximate thereto and projecting from an outer periphery surface 30*a* of spout 30. Outer surface 30*a* of spout 30 preferably is of generally oval or elliptical configuration with knurlings, vertical ribs 35*b* and vertical grooves 35*c* and bumps 35*a*, to facilitate grasping of the spout by a user to effect a twist motion thereto.

Figure 7:
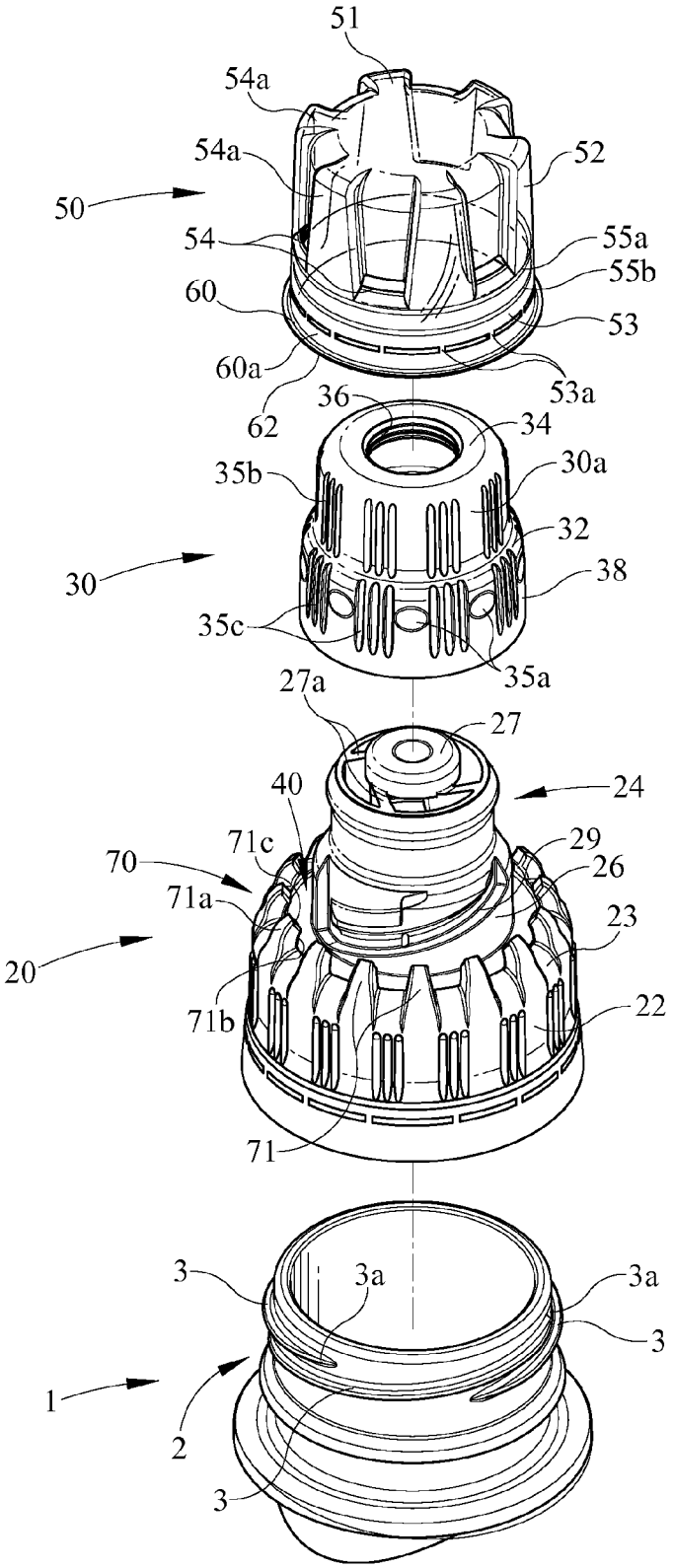
FIG. 7 shows a top perspective view of the embodiment of FIG. 1 with the dispensing closure exploded away from the container neck.
Figure 8:
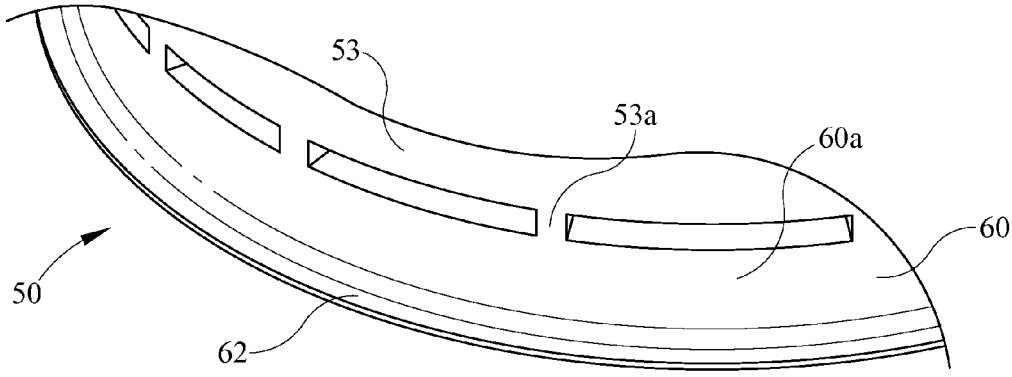
FIG. 8 shows an enlarged, partial perspective view of the tamper indicating band of the overcap of FIG. 1 disengaged from the closure base.
Figure 9:
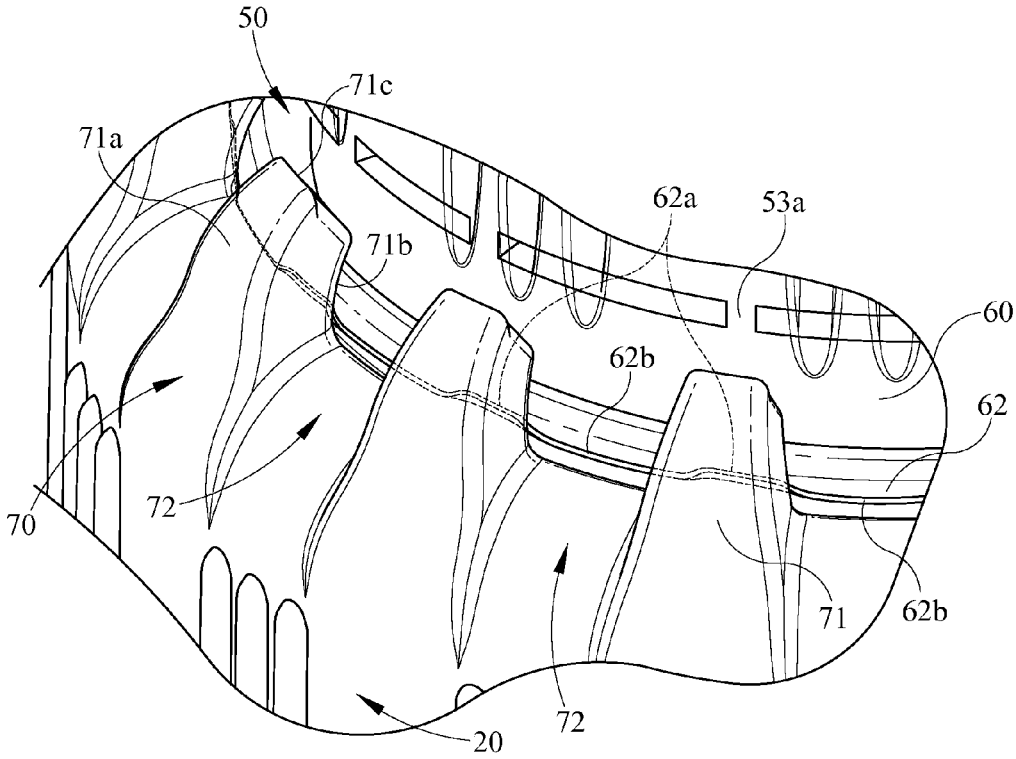
FIG. 9 shows an enlarged, partial perspective view of the overcap of FIG. 8 illustrating the interaction between the tamper indicating band of the overcap with the closure base.
Figure 10:
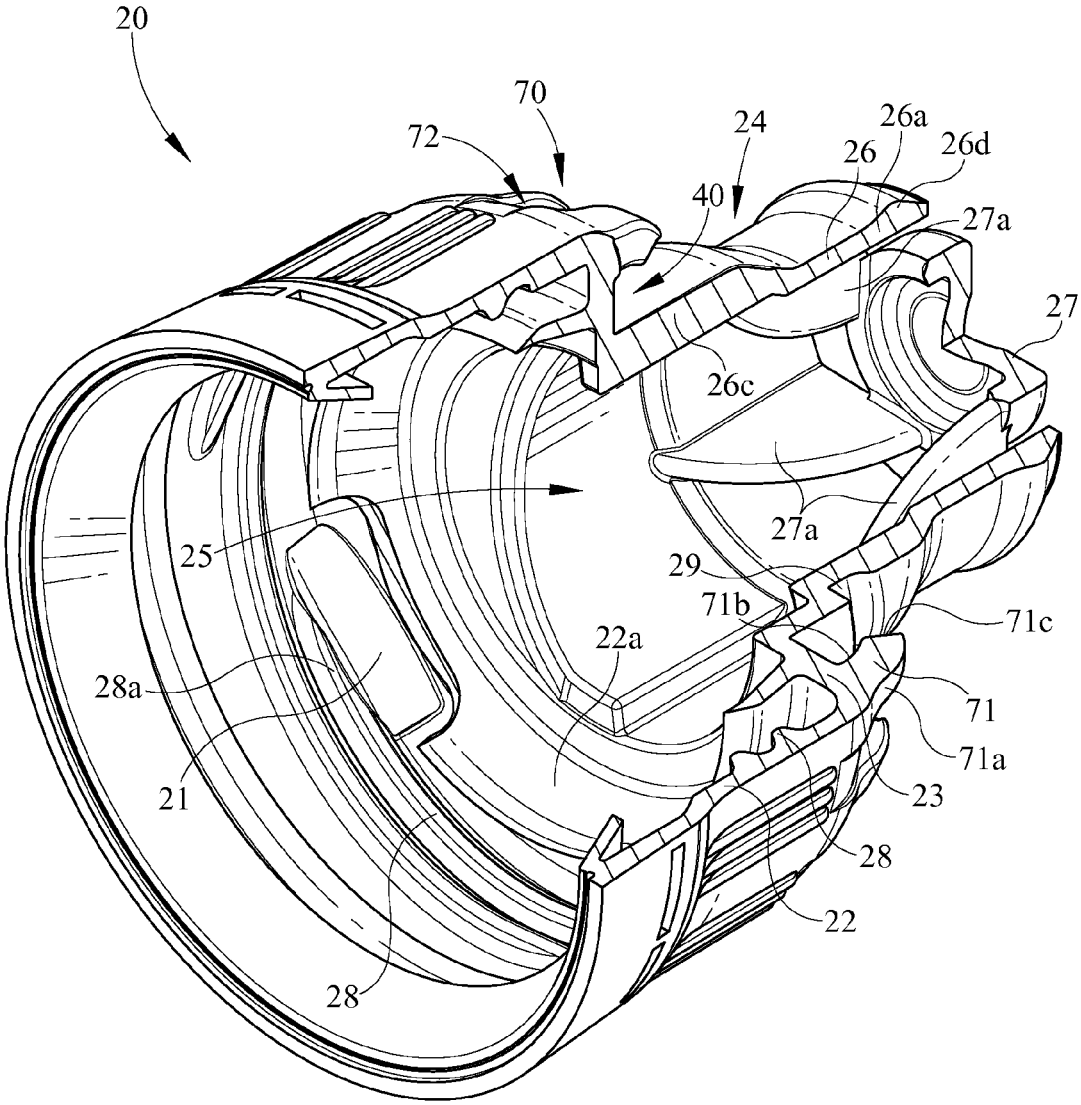
FIG. 10 shows a bottom perspective view of the closure base with portions of the closure base partially broken away illustrating a lug adjacent the closure thread.
Figure 11:
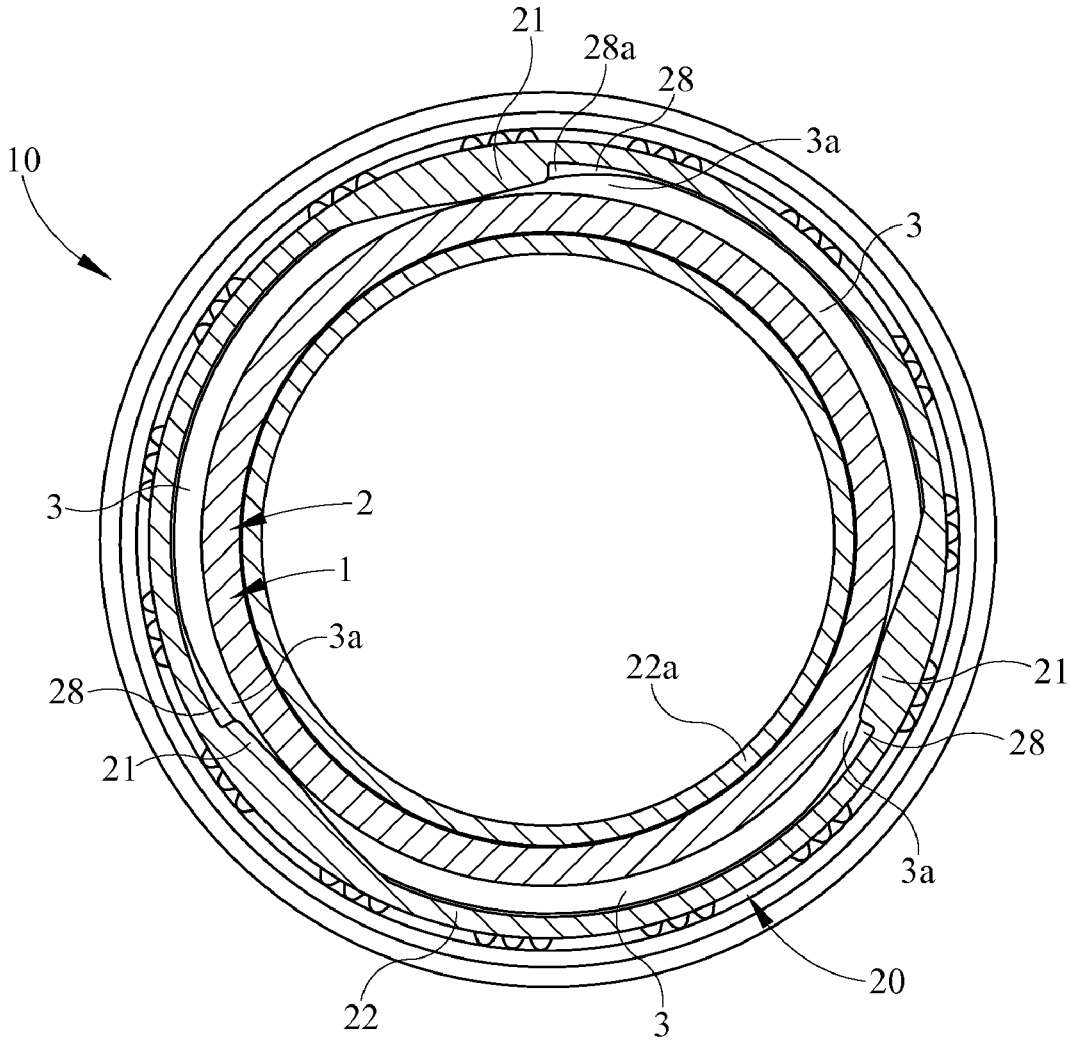
FIG. 11 shows a sectional view of the closure embodiment of FIG. 1 taken along line 11-11 illustrating the interaction between each closure lug and respective thread of the container neck.

As shown in FIGS. 5-7, an inner periphery surface 30*b* of spout 30 is adapted for cooperative engagement upon post 24 of base 20, and is formed with a pair of oppositely disposed, radially inwardly projecting drive threads 37, 39. Respective drive threads 37, 39 are equally spaced around the spout circumference from each other, and are matingly engageable within respective helical grooved channels 29 formed on post 24. Twisting of spout 30 causes threads 37, 39 to travel in channels 29 and thereby draw the spout downwardly upon post 24 to the closed position of spout 30 shown in FIG. 5. In said closed position, sealing plug 27 of post 24 engages within aperture 36 to seal the aperture and prevent dispensing of product therethrough.

Opening of twist spout 30 is accomplished by counter-turning the spout 30 on base 20 thereby causing threads 37, 39 to reverse-travel in channels 29 and move the spout upwardly on post 24 to the opened position shown in FIG. 6. When spout 30 is moved to its opened position, plug 27 is withdrawn from engagement with aperture 36, and product thereby may be dispensed from container 1 through passage 25 in base 20 and out aperture 36 of spout 30.

FIGS. 1, 2, 5, and 7-9 illustrate closure 10 with overcap 50 in association therewith. Although overcap 50 is shown in association with closure 10, it is to be understood that the overcap can be used with other types of closures within the contemplation of the present embodiment.

Overcap 50 may be formed of opaque, translucent or transparent material, the latter being illustrated in the drawings. As shown in FIGS. 1, 2, 5, and 7, overcap 50 includes a domed top portion 51 with depending circumferential skirt 52 having a lower edge 53 connected by frangible connections 53*a* to a tamper indicating band 60 which is permanently retained within channel 40 of base 20 upon assembly of the overcap with base 20 and spout 30. The interior surface configuration of overcap 50 may be substantially conforming to the outer periphery surface 30*a* of spout 30. Skirt 52 may have a plurality of vents 54 therethough. An interior wall 52*b* of skirt 52 has an upper circumferential bead 55*a* and a lower circumferential bead 55*b* adjacent the lower edge 53. Upper and lower circumferential beads 55*a*, 55*b* operably engage bumps 35*a* of spout 30 to allow overcap 50 to engage the spout when either in the closed position (FIGS. 1, 2, and 5) or open position (not shown) after severing frangible connections 53*a*. When overcap 50 is engaged with spout 30, one or more vents 54 may align with a plurality of vertical grooves 35*c* to provide for drainage of material through overcap 50 and allow for evaporation of moisture. Raised sections 54*a* or knurlings between adjacent vents 54 facilitate grasping of overcap 50 by a user to effect a twist motion thereto in order to sever frangible connection 53*a* and separate lower edge 53 of the overcap from tamper indicating band 60 of the overcap. Although a specific generally circular configuration of overcap 50 is shown in the drawings, it is to be understood that other configurations, for example oval configurations, are within the scope and contemplation of the invention.

Figure 2:
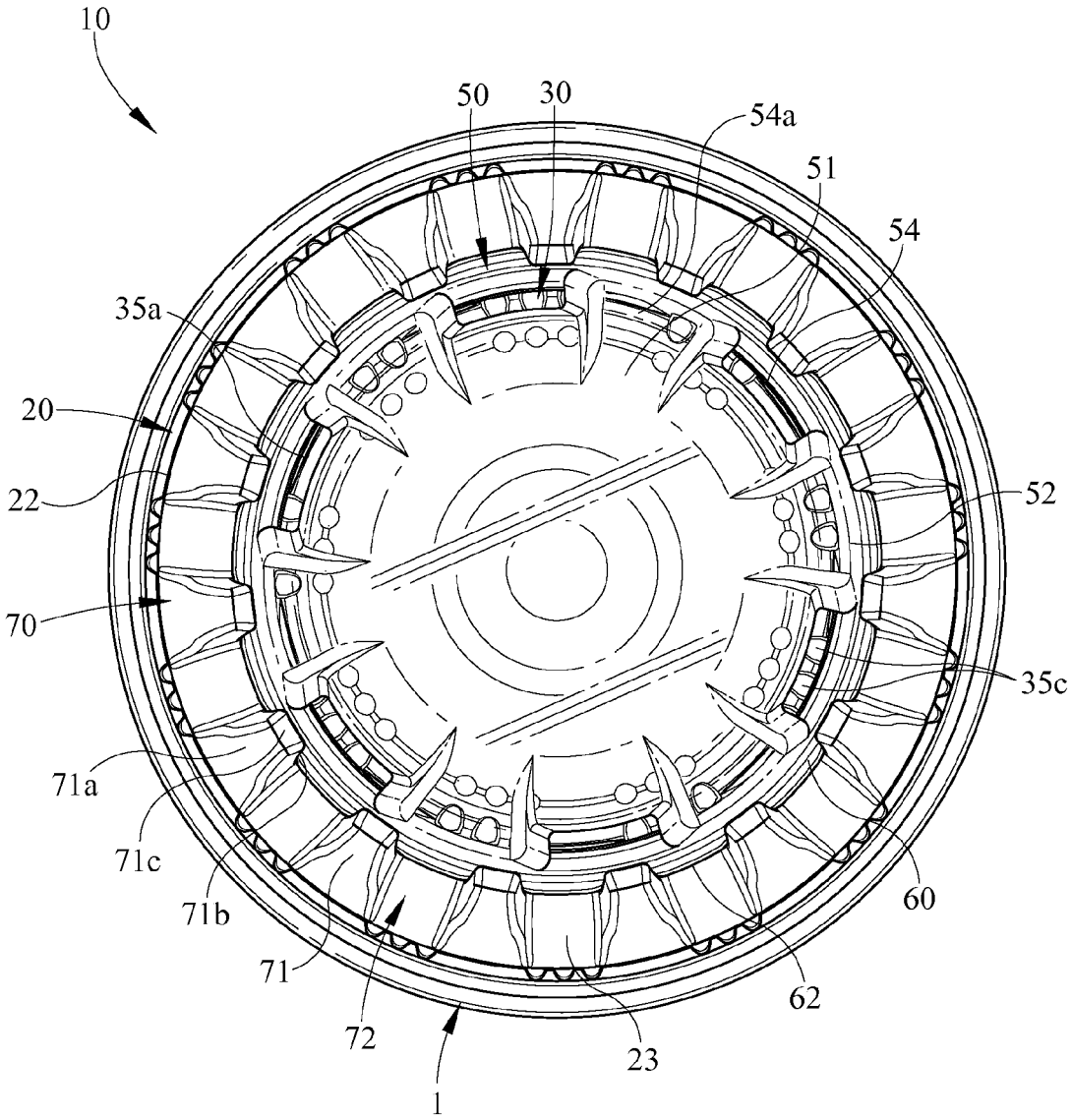
FIG. 2 shows a top view the dispensing closure of FIG. 1.
Figure 3:
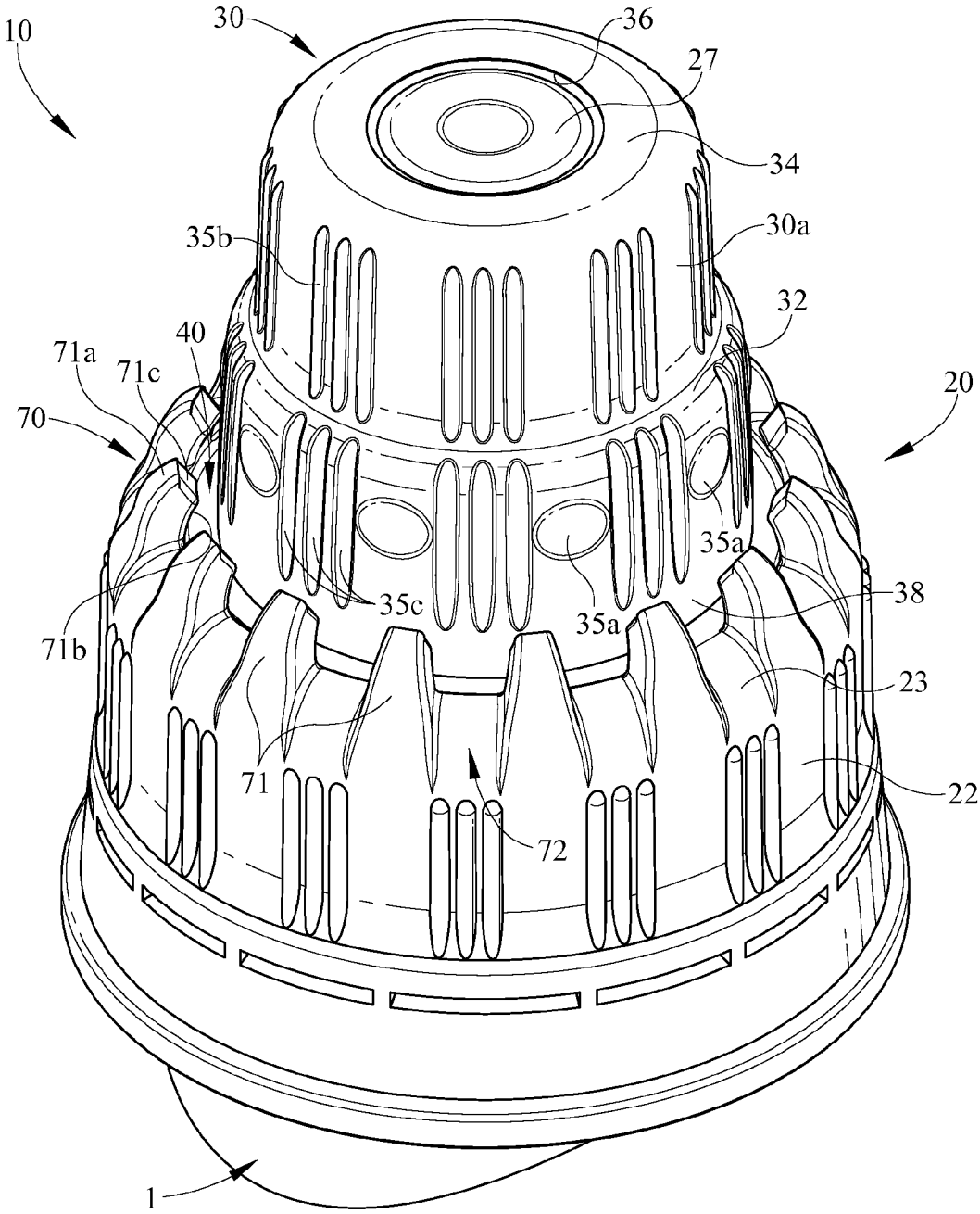
FIG. 3 shows a top perspective view of the dispensing closure of FIG. 1 with the overcap removed and portions of the container partially broken away.
Figure 4:
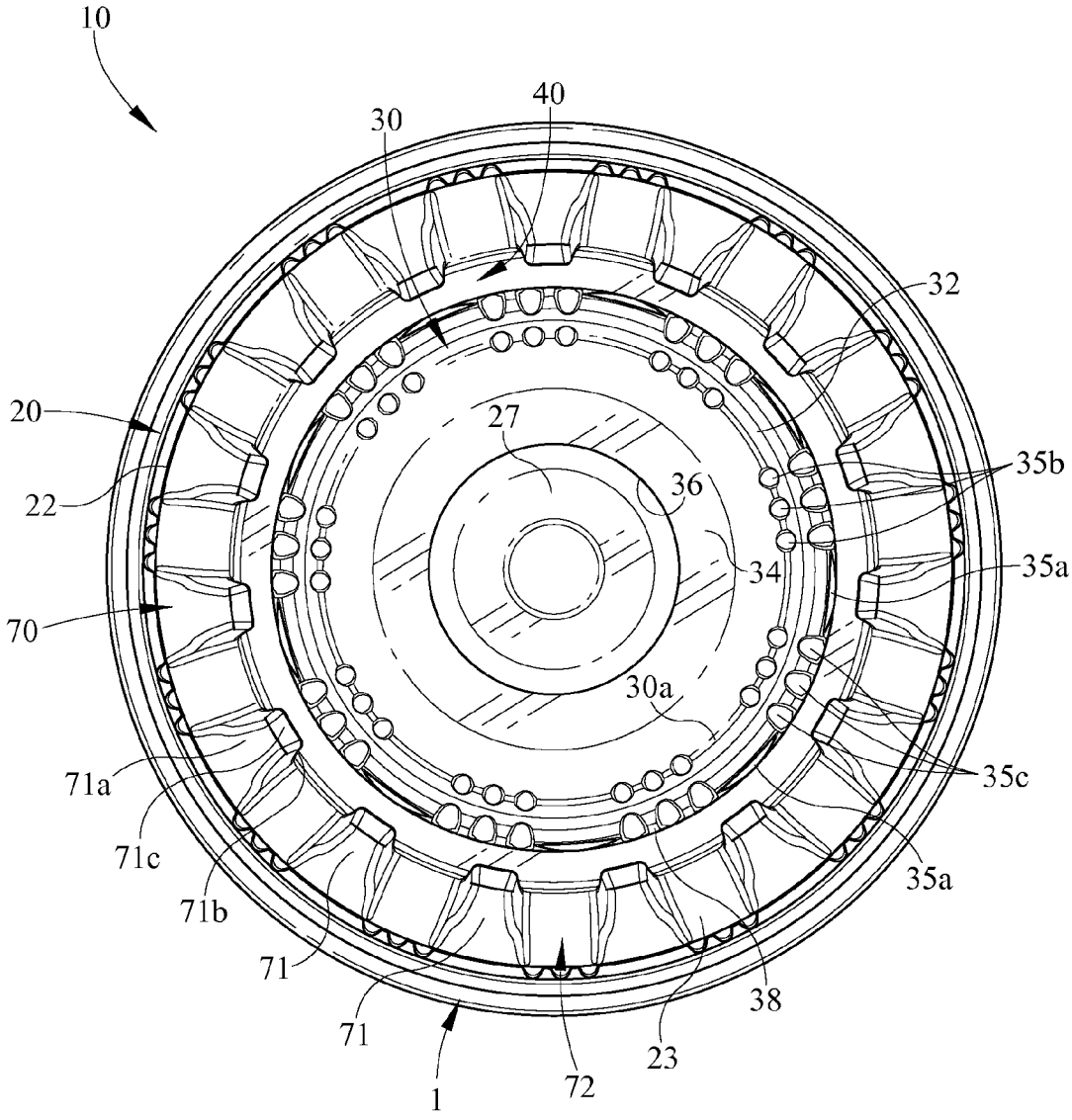
FIG. 4 shows a top view of the dispensing closure of FIG. 3.

When overcap 50 is assembled upon closure base 20, spout 30 is in its closed position illustrated in FIGS. 1, 2, and 5. When it is desired to move spout 30 to its open position (FIG. 6) with respect to base 20, a twisting force is asserted on the overcap exterior wall 52*a*. Upon such twisting movement, frangible connections 53*a* are severed and overcap 50 is removed from spout 30 while tamper indicating band 60 is retained within base 20 which plainly signifies to the viewer the fact that an overcap has been removed. Also, the closure may be opened such that twisting of the overcap may also result in twisting of the spout. Structural conforming between the inner surface of the overcap and the outer surface of the spout may move the spout upwardly to its open position while the overcap is twisted and subsequently removed. Thus, reverse operation can be effected to move the spout to its closed position.

As shown in FIGS. 1-7, 9, and 10, a plurality of flanges 71 creates a circumferential flange 70 curving inwardly towards the post 24 or spout 30. Each base flange 71 projects from deck 23 of base 20. Each curved base flange 71 has an outer curved surface 71*a* and a concave or inner curved surface 71*b*. Outer curved surface 71*a* has a larger arc than inner curved surface 71*b*. A sloped surface 71*c* positioned at the distal end of each flange 71 connects outer curved surface 71*a* and inner curved surface 71*b*. Sloped surface 71*c* angles downwardly towards concentric channel 40 which guides tamper indicating band 60 of overcap 50 into its assembled position with closure base 20 and spout 30. The curve of each base flange 71, both inner curved surface 71*b* and outer curved surface 71*a*, may facilitate closure base 20 to be pulled out from the mold cavity. Between adjacent flanges 71 is a gap or opening 72. Gap 72 extends adjacent to the bottom of channel 40 which may allow water or material to flow or pass through from the upper portion of closure 10 and may reduce moisture that may be present. Each base flange 71 or the plurality of base flanges creating the circumferential flange 70 also may function as a tooth guard. The interaction of the base flange 71 with overcap 50 act as a tooth guard to inhibit children from using their teeth or "biting" to pry off the overcap, tamper indicating band, or a variety of other possible closure structures such as but not limited to the spout or a lid (not shown).

As shown in FIGS. 1 and 5, overcap 50 with tamper indicating band 60 is retained within channel 40 upon assembly of the overcap with spout 30 and base 20. Tamper indicating band 60 is press fitted in position within channel 40 between the plurality of base flanges 71 and spout 30. Once inserted, tamper indicating band 60 is permanently fixed between the plurality of base flanges 71 creating circumferential base flange 70 and spout 30. Tamper indicating band 60 has an outer peripheral wall 60*a* and an inner peripheral wall 60*b*. Outer peripheral wall 60*a* is contacted outwardly by the plurality of base flanges 71. Inner peripheral wall 60*b* is radially maintained by outer periphery surface 30*a* of spout 30. Spout 30 maintains contact with tamper indicating band 60 between both the closed position (FIG. 5) and the open position (FIG. 6) preventing substantial radially inward displacement of the tamper indicating band. Otherwise, radially inward displacement of tamper indicating band 60 could result in a failed tamper indicating device such that the tamper indicating band does not remain in channel 40 of closure base 20. As shown in FIG. 6, the distance D that lower terminal end 38 of spout 30 travels between its closed and opened position is less than the vertical height of tamper indicating band 60 insuring that a portion of the spout maintains contact with the inner peripheral wall 60*b* of the tamper indicating band. Because inner peripheral wall 60*b* of tamper indicating band 60 is in contact with and at least partially retained by spout 30, instead of being in contact with a portion or inner flange of the base 20 (not shown) as previously used in the art, the diameter of base 20 and container neck 2 may be reduced resulting in less material needed for their construction and therefore also providing for a reduced diameter of overcap 50 as well.

As will be recognized by those skilled in the art, a variety of tamper indicating means or devices may also be used that will still permit the spout in each of its closed and open positions to secure the tamper indicating device with the closure. Of course, the tamper indicating device and the spout each may be provided in a variety of shapes, sizes, positions, and various interactions therebetween on the closure and still allow the spout to be utilized to provide retention of the tamper indicating device.

As shown in FIGS. 1, 2, and 5-9, tamper indicating band 60 has an outwardly projecting flange 62 circumferentially extending from the distal free end of the band spaced from frangible connections 53*a*. Flange 62 is flexible and in a relaxed first state (FIG. 8) before assembly to the remainder of closure 10. Also, the outer diameter of tamper indicating flange 62 is larger than the inner diameter of each base flange 71. However, upon placement of overcap 50 onto spout 30 and base 20 during assembly, specifically when tamper indicating band 60 is positioned in channel 40, tamper indicating flange 62 is deformed or positioned into a second state (FIG.

9) in which a tamper indicating flange portion 62*a* radially adjacent to each base flange 71 is deformed to flex inward and/or curve upward adjacent to and in contact with inner curved surface 71*b* of each base flange 71. Also in the second state or assembled position of tamper indicating flange 62, a projecting tamper indicating flange portion 62*b*, between adjacent inwardly flexed tamper indicating flange portions 62*a*, projects outward between adjacent base flanges 71 into gaps 72. As time progresses after assembly of overcap 50, the second state (FIG. 9) of tamper indicating flange 62 becomes increasingly fixed in position or "cold flow" occurs. "Cold flow" occurs when the material of tamper indicating flange 62 becomes rigid in its fixed or second state position (FIG. 9) as a result of outside structural forces applied from base 20 thereto. Thus each curved base flange 71 deforms the tamper indicating flange 62*a* into an inwardly direction while allowing the projecting tamper indicating flange portion 62*b* to deform radially outward in gap 72 between adjacent base flanges 71. As a result, tamper indicating flange 62 of tamper indicating band 60 in the second state (FIG. 9) has a substantially scalloped shape, ruffled edge, or alternating pattern functioning as an interlocking or anti-rotational mechanism with base 20 to prevent rotation of the tamper indicating band. Therefore, tamper indicating flange 62 in the interlocked or anti-rotationally deformed position with the plurality of base flanges 71 is sufficiently fixed relative to frangible connections 53*a* to allow frangible connections 53*a* to be severed upon twisting of overcap 50, while tamper indicating band 60 remains fixed in channel 40. This interlocking or anti-rotational mechanism permits overcap 50 to be press fitted in any orientation while still ensuring an aligned engagement with base 20 and spout 30. Eliminating the need to orient overcap 50 allows a decrease in the time needed to combine overcap 50 to base 20 during manufacture.

Upon assembly with base 20 and spout 30, tamper indicating flange 62 of tamper indicating band 60 engages each curved base flange 71. As described above and shown in FIGS. 1, 2, 5-7, and 9, tamper indicating band 60 has restricted movement radially inward due to the spout 30 in both closed (FIG. 5) and open (FIG. 6) positions relative to post 24. Tamper indicating band 60 is restricted radially outward due to the plurality of base flanges 71 spaced radially outward therefrom. Still, tamper indicating band 60 is allowed limited vertical movement in its contact with the outer periphery surface 30*a* of spout 30 and with each base flange 71. The inner curved surface 71*b* of each base flange 71 creates a restricted vertical space or narrowing vertical space from base deck 23 which sufficiently restricts flange 62 of tamper indicating band 60 from traveling upward and inhibiting its tamper indicating function. Inwardly flexed tamper indicating flange portion 62*a* is frictionally resisted in its movement along inner curved surface 71*b* of base flange 71. As the vertical space radially inward from the inner curved surface 71*b* decreases, the tamper indicating band 60 progressively becomes harder to move vertically. Thus, the plurality of frangible connections 53*a* will be severed prior to either substantial upward and/or rotational movement of tamper indicating band 60. Also, tamper indicating band flange 62 contacts not only inner curved surface 71*b* but may partially extend out between adjacent curved flanges 71 and extend into gap 72, increasing the resistance of band 60 to movement and thereby facilitating the severing of the frangible connections 53*a*.

As shown in FIGS. 5, 6, 10, and 11, the use of a stopping mechanism such as but not limited to a lug or plurality of lugs 21 may reduce assembly complications at the time of initial application of closure 10 to container 1 and during the useful life of the closure. Specifically, at the time of assembling closure 10 with container 1, the capping torque applied to the closure may be sporadic and is not a precisely controllable variable. In such case the use of lug 21 provides sufficient strength to resist over-torque during the capping process. Lug 21 thus reduces the potentially deleterious effects of over-torque, for example, preventing the over tightening of the closure which may lead to "doming" of the closure. "Doming" may occur when closure 10 is over threaded upon container neck 2, such that deck 23 may disfigure or dome due to the closure skirt being threaded past its intended application upon the container. As a result of this over torque and subsequent doming effect, the plurality of base flanges 71 may deviate or mushroom outward away from spout 30 resulting in failure to maintain contact with overcap 50. To reduce over-torque and subsequent over threading of closure 10, a lug 21 may be used that projects from the interior of side wall 22 of closure base 20 and adjacent to a terminating end 28*a* of the closure helical thread 28 adjacent deck 23. As shown in the FIG. 11, lug 21 may be present at the end of each thread 28 of a multiple threaded engagement of closure 10. Thus, when closure base 20 is thread upon container neck 2 (FIGS. 5, 6, and 11), each leading end 3*a* of container thread 3 engages each respective lug 21 preventing the closure side wall 22 from further rotation and traveling past the desired vertical distance upon container neck 2 reducing any doming that may occur. Each leading end 3*a* of container thread 3 rotates up to and stops or may ramp upon lug 21 binding the closure 10 from further rotation. This binding may occur at each lug 21 at substantially the same time. As a result of this over torque structure or engagement, closure 10 may not only reduce over torque but may tend to cause each base flange 71 to curve or deflect inward towards spout 30 increasing hoop strength and contact with overcap 50, specifically tamper indicating band 60. A plug seal 22*a*, as shown in FIGS. 5, 6, 7, and 11, may also be used in the closure to seal the container opening. Closure 10 may engage container neck finish 2 by a variety of removable and non-removable means known in the art. The engagement between closure 10 and container 1 need not be a threaded engagement as shown or even have to have the over torque stops or lugs 21, but may be other engagements such as a non-removable engagement such as but not limited to dual snap-fit engagements, or a mating bead and groove engagement.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

We claim:

1. A closure with an overcap comprising:

a base adapted to be secured to a mouth of a container, said base having a circumferential post wall extending upwardly from a deck and a side wall depending peripherally from said deck, said base further having a plurality of circumferentially spaced upwardly projecting base flanges, wherein each one of said base flanges is positioned at a first radius;

a spout positioned on said post wall of said base and moveable telescopically thereon between an open position and a closed position with respect to said base;

an overcap disposed over said spout, said overcap having a depending skirt connected to a tamper indicating band, and a frangible line of weakness between said skirt and said tamper indicating band;

said tamper indicating band having an outwardly projecting flange; and said flange being anti-rotationally deformed by said plurality of base flanges.

2. The closure as in claim 1 wherein said outwardly projecting flange of said tamper indicating band is substantially flexible.

3. The closure as in claim 1 wherein said outwardly projecting flange of said tamper indicating band flexes inward adjacent each said base flange.

4. The closure as in claim 1 wherein said outwardly projecting flange deforms into a scalloped shape when assembled with said base.

5. The closure as in claim 1 wherein each of said base flanges has a concave surface engaging said tamper indicating band.

6. A closure comprising:

a base adapted to be secured to a mouth of a container, said base having a deck, a side wall depending peripherally from said deck, and a plurality of curved flanges circumferentially spaced and upwardly projecting from said deck, wherein each one of said curved flanges is positioned at a first radius;

a spout positioned on said base and moveable telescopically on a post extending upwardly from said base, said spout movable between an open position and a closed position with respect to said base; and an overcap positionable between an assembled position and a preassembled position, said overcap having a depending skirt connected to a tamper indicating band and a frangible line of weakness between said skirt and said tamper indicating band, said tamper indicating band having a circumferential flange when in said preassembled position before assembly with said base, said flange is anti-rotationally deformed by said plurality of curved flanges when in said assembled position with said base.

7. The closure as in claim 6 wherein said circumferential flange of said tamper indicating band projects between adjacent said curved flanges when in said assembled position.

8. The closure as in claim 6 wherein said circumferential flange of said tamper indicating band flexes inwardly at each of said curved flanges when in said assembled position.

9. The closure as in claim 6 wherein said circumferential flange of said tamper indicating band has an outer diameter larger than an inner diameter of said plurality of curved flanges of said base.

10. The closure as in claim 6 wherein each of said curved flanges has an interior curved surface and an exterior curved surface.

11. The closure as in claim 6 wherein said spout engages the interior surface of said tamper indicating band when in either said open position or said closed position.

12. A closure with an overcap comprising:

a base adapted to be secured to a mouth of a container, said base having a deck, a side wall depending peripherally from said deck, and a plurality of upwardly projecting base flanges circumferentially spaced on said base, wherein each one of said base flanges is positioned at a first radius;

a spout positioned on a post of said base and moveable telescopically thereon between an open position and a closed position;

said overcap disposed over said spout, said overcap having a depending skirt connected to a tamper indicating band, and a frangible line of weakness between said skirt and said tamper indicating band; and said tamper indicating band having an outwardly projecting flange, wherein said outwardly projecting flange extends between said base flanges and flexes inwardly at each of said base flanges.

13. The closure as in claim 12 wherein each of said upwardly projecting base flanges has an interior curved surface and an exterior curved surface, wherein said interior curved surface engages said outwardly projecting flange of said tamper indicating band.

14. The closure as in claim 13 wherein said outwardly projecting flange is substantially scalloped in shape.

15. The closure as in claim 13 wherein said interior curved surface has a smaller arc than said exterior curved surface.

16. The closure as in claim 12 wherein said plurality of base flanges limits axial and rotational movement of said tamper indicating band.

17. The closure as in claim 12 wherein said plurality of base flanges projects from said deck adjacent said side wall of said base.

18. The closure as in claim 12 wherein said outwardly projecting flange of said tamper indicating band is spaced from said frangible line of weakness of said tamper indicating band.

19. The closure as in claim 12 wherein said outwardly projecting flange is anti-rotationally deformed by said plurality of base flanges.

20. The closure as in claim 12 wherein said outwardly projecting flange is substantially flexible.

21. A dispensing closure with a dust cover, comprising:

a closure having a deck and depending side wall with an upstanding post to receive a spout, said spout vertically repositionable on said post to move relative to said base between a closed position and an open position;

wherein said closure further has a product flow channel extending through said post; and a dust cover fitting over said spout and releasably engageable on said closure and having a lower edge in deformable engagement with a plurality of upwardly extending talons, said talons intermittently formed along a first radius on said closure.

* * * * *